US006501635B1

(12) United States Patent
Fröhlich et al.

(10) Patent No.: US 6,501,635 B1
(45) Date of Patent: Dec. 31, 2002

(54) QUICK-ACTION MECHANICAL SWITCHING POINT

(75) Inventors: Klaus Fröhlich, Baden (CH); Walter Holaus, Zürich (CH); Kurt Kaltenegger, Lengnau (CH), C; Michael Steurer, Bülach (CH)

(73) Assignee: ABB Hochspannungstechnik AG, Zurich (CH)

( * ) Notice: Subject to any disclaimer, the term of this patent is extended or adjusted under 35 U.S.C. 154(b) by 120 days.

(21) Appl. No.: 09/610,619

(22) Filed: Jul. 5, 2000

(30) Foreign Application Priority Data

Jul. 6, 1999 (EP) ..... 99810596

(51) Int. Cl.[7] ..... H01H 47/00
(52) U.S. Cl. ..... 361/160; 361/152
(58) Field of Search ..... 361/115, 23, 42, 361/45, 78, 86, 93.1, 160, 152

(56) References Cited

U.S. PATENT DOCUMENTS 2,951,188 A 8/1960 Diebold ..... 317/156
3,268,687 A 8/1966 Waghorne et al. ..... 335/71

FOREIGN PATENT DOCUMENTS

| | | | |
|---|---|---|---|
| CH | 348442 | 10/1960 | |
| DE | 1091658 | 10/1960 | ..... H02D/68/01 |
| EP | 0147036 A1 | 7/1985 | ..... H01H/33/28 |
| EP | 0800195 A2 | 10/1997 | ..... H01H/77/06 |

*Primary Examiner*—Stephen W. Jackson
(74) *Attorney, Agent, or Firm*—Burns, Doane, Swecker & Mathis, L.L.P.

(57) ABSTRACT

The switching point in a high or medium voltage switch contains two stationary switch pieces which are of cylindrical design and led coaxially into one another, to form an annular gap. A movable bridge switch piece constructed in the form of a contact ring fits into the annular gap when the switching point is closed. An electrodynamic drive comprising two coils moves the contact ring in the axial direction. By virtue of the low mass of the contact ring, the single moving part of the switching point can be switched on and off very quickly and efficiently.

11 Claims, 2 Drawing Sheets

QUICK-ACTION MECHANICAL SWITCHING POINT

This application claims priority under 35 U.S.C. §§119 and/or 365 to Appln. No. 99 810 596.9 filed in Europe on Jul. 6, 1999; the entire content of which is hereby incorporated by reference.

FIELD OF THE INVENTION

The invention is based on a switching point in a high or medium voltage switch.

BACKGROUND OF THE INVENTION

A switching point of the abovementioned type is described in EP 0 147 036. A bridge switch piece fixed to an electrically conductive disk short-circuits two stationary switch pieces when the switching point is closed. A flat coil is fitted on each of the two sides of the disk in such a way that the disk can be moved between the two coils by means of electrodynamic forces, the bridge switching piece canceling or reestablishing the short circuit between the stationary switch pieces. When the switching point is closed, a current is fed into the first coil and, in the disk, effects an eddy current directed opposite to the current in the coil. The two coils have a repellent action on each other, as a result of which the movable disk is removed from the stationary coil and the bridge switch piece cancels the short circuit between the stationary switch pieces. In order to move the disk back and to bring the bridge switch piece onto the stationary switch pieces again, producing the short circuit, a current is fed into the second coil.

SUMMARY OF THE INVENTION

The invention, as is based on the object of specifying a switching point of the type mentioned at the beginning which can be opened and closed quickly and with a low expenditure on energy.

The switching point according to the invention is of axially symmetrical construction. As a result, it is possible largely to avoid undesired stray inductances, which is advantageous in particular in the case of possible commutation of the current onto a parallel path. The induction current necessary to form the forces of an electodymanic contact drive is generated in the movable bridge switch piece which carries the nominal current, as a result of which a disk-like part, which is otherwise provided to guide the induction current, and thus additional mass to be accelerated can be saved. By this means, the drive energy necessary to achieve a specific opening or closing speed of the switching point is minimized. In addition, during the opening operation, two contact gaps are produced, which are in each case bridged by one of two partial arcs connected in series. As a result of this series connection of partial arcs, the arc voltage dropping across a contact arrangement of the switching point is increased, whereby once again, in the event of a possible parallel path, commutation can be carried out particularly quickly and effectively.

BRIEF DESCRIPTION OF THE DRAWINGS

Preferred embodiments of the invention and the further advantages that can be achieved therewith will be explained in more detail below using drawings, in which.

DETAILED DESCRIPTION OF THE INVENTION

Figure 1:
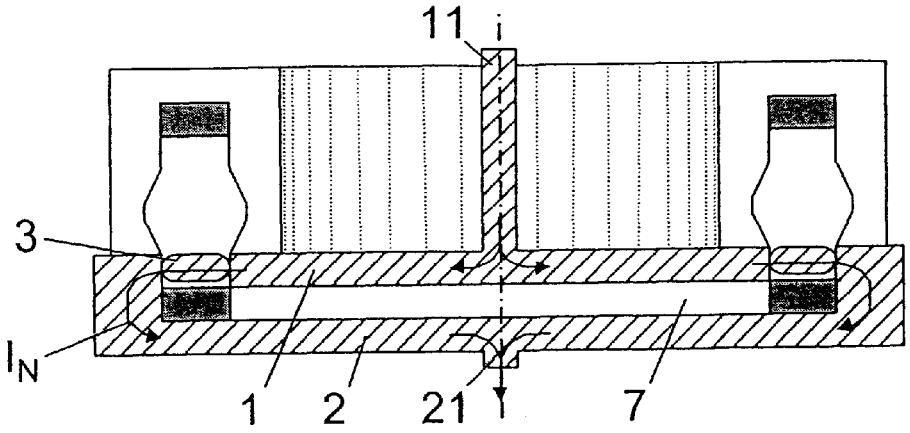
FIG. 1 shows a plan view of a section, made along an axis, through a contact arrangement and two coils of the switching point according to the invention in the closed state.
Figure 2:
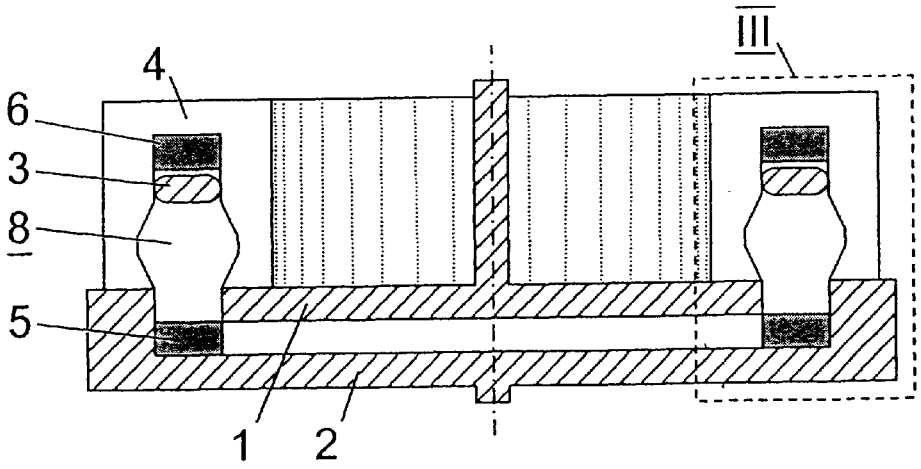
FIG. 2 shows the contact arrangement and the coils of the switching point of FIG. 1 in the opened state.

In all the figures, identical reference symbols relate to identical parts. FIG. 1 shows a contact arrangement of the switching point according to the invention in the closed state. A nominal current $I_N$ flows from a first terminal 11 through a stationary switch piece 1, a movable bridge switch piece constructed as a contact ring 3, and a stationary switch piece 2, to a second terminal 21. The stationary switch piece 1 is constructed as a disk and surrounded by the stationary switch piece 2, which is of essentially cylindrical construction. The two stationary switch pieces 1 and 2, which are led coaxially into one another, and the contact ring 3 fitting in between them together form the contact arrangement. The contact arrangement is carried by an electrically insulating contact carrier 7. As can be seen from FIG. 2, the circular ring 3 can be moved in the axial direction. As a result, the contact arrangement can be opened and the nominal current $I_N$ can be interrupted. In order to drive the contact ring 3, the switching point contains an electrodynamic drive, having two annular, flat coils 5 and 6. In the axial direction, the two coils 5 and 6 bound an annular space 8, in which the circular ring 3 moves to and fro. In the radial direction, the annular space 8 is bounded by an insulating element 4, which additionally carries the coil 6.

Figure 3:
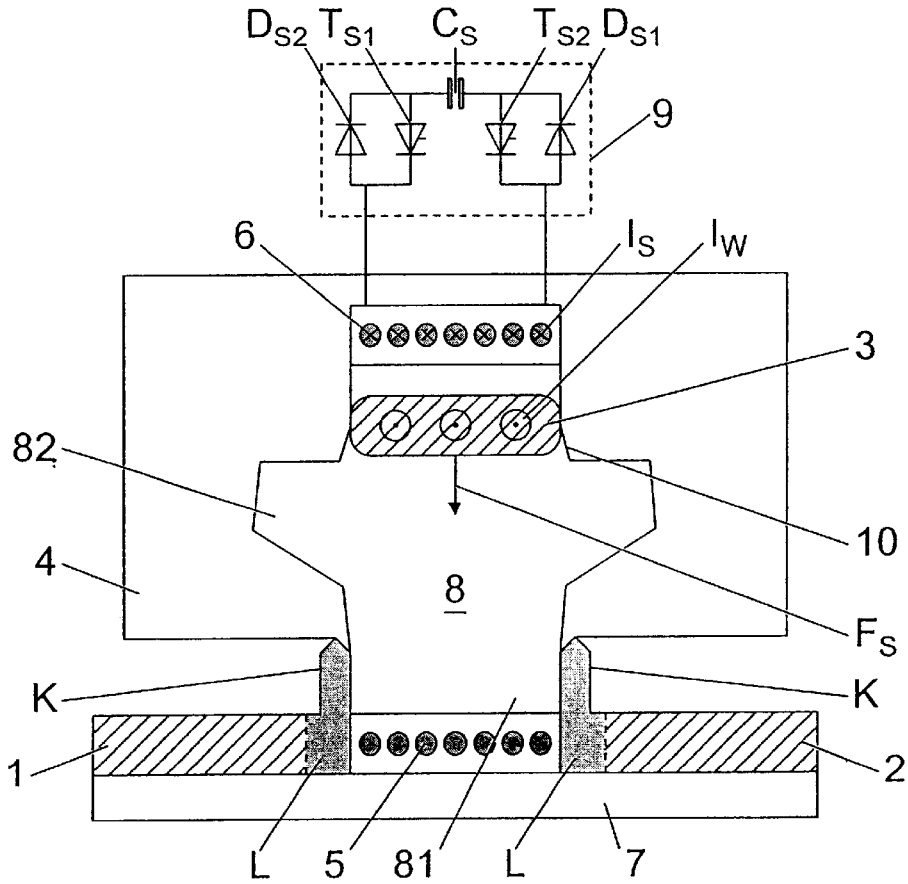
FIG. 3 shows a first embodiment of the switching point according to the invention with a part of the contact arrangement according to FIG. 2 illustrated enlarged, with part of a first power electronic control unit at the start of a closing operation.

The precise geometric design of the contact arrangement can be seen from FIG. 3. The two stationary switch pieces 1 and 2 form a gap 81. This gap is sufficiently wide that when the switching point is closed the contact ring 3 fits in exactly and on both sides has good electrical contact with the stationary switch pieces 1 and 2. Toward the gap 81, the switch pieces 1 and 2 are provided with contact fingers K. The contact fingers K are separated from each other by slots L and have a slight spring action in the radial direction. As a result, the mechanical retention of the contact ring 3 in the gap 81 and the electrical contact are improved. Fitted underneath the gap 81 is the first coil 5, which is needed to open the contact arrangement. In the illustrated, open state of the switching point, the contact ring 3 is at the other end of the annular space 8, in a retaining device 10 whose task it is to hold the contact ring 3 firmly. Fitted above the retaining device 10 is the second coil 6, which is needed to close the contact arrangement. The insulating element 4 is pressure-resistant and is fixed in a gas-tight manner to the stationary switch pieces 1 and 2. The annular space 8 has a region 82 that is widened in the radial direction between the gap 81 and the retaining device 10. The annular space 8 is filled with a gaseous medium, for example air or $SF_6$ under atmospheric or higher pressure.

Figure 4:
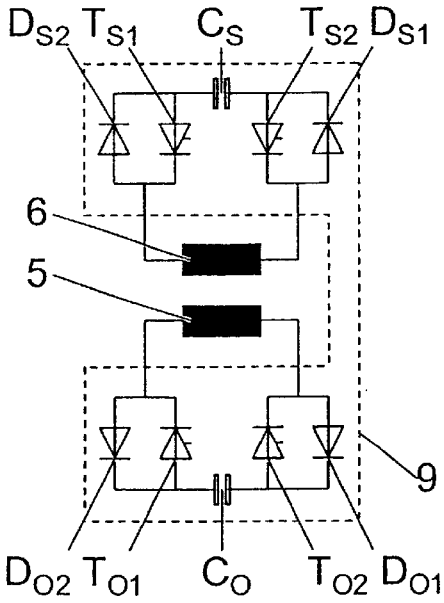
FIG. 4 shows a schematic illustration of the switching point of FIG. 3 with the first control unit.

The two coils 5 and 6 are fed by a power electronic control unit 9. FIG. 3 and FIG. 4 show a first embodiment of the control unit 9 of the switching point according to the invention. A first capacitor $C_S$ and two thyristors $T_{S1}$ and $T_{S2}$ with antiparallel-connected freewheeling diodes $D_{S2}$ and $D_{S1}$ are connected to the coil 6 to form a first circuit. In a similar way, a second capacitor $C_O$ and two further thyristors $T_{O1}$ and $T_{O2}$ with antiparallel-connected freewheeling diodes $D_{O2}$ and $D_{O1}$ are connected to the coil 5 to form a second tuned circuit.

The functioning of the drive of the switching point will be explained with reference to a closing operation, as illustrated in FIG. 3. The contact ring 3 is located in the retaining device 10, the capacitor $C_S$ is positively charged and the two thyristors $T_{S1}$ and $T_{S2}$ are off. By firing the thyristor $T_{S1}$, which is polarized positively with respect to the charge voltage on the capacitor $C_S$, the capacitor $C_S$ is discharged via $T_{S1}$, the coil 6 and the freewheeling diode $D_{S1}$. The result is a sinusoidal current pulse $I_S$ in the drive coil 6, which effects an eddy current $I_W$ in the contact ring 3 located directly underneath. The drive current $I_S$ and the eddy current $I_W$ have opposed directions, which results in a repellent action $F_S$ between the contact ring 3 and coil 6. The coil 6 is firmly connected to the insulating element 4. The contact ring 3 is accelerated downward and only damped as it enters the gap 81, by an air cushion enclosed in the gap 81 and by the action of friction. When it strikes the coil 5 fitted beneath, it is ultimately finally braked. With the coil 6, the capacitor $C_S$ forms a series tuned circuit. The result of firing the thyristor $T_{S1}$ once is therefore a ring-around process of the capacitor $C_S$. The capacitor $C_S$ is then charged negatively with a voltage somewhat smaller than the original, since the DC resistances in the circuit result in electrical losses. In order then to prevent the contact ring 3 bouncing back from the completely closed position in the gap 81, the thyristor $D_{S2}$ is fired, whereby the capacitor $C_S$ changes its charge a second time via $T_{S2}$, the coil 6 and the freewheeling diode $D_{S2}$. Because of the greater distance between the contact ring 3 and the coil 6, the result is then a lower force impulse $F_S$ on the contact ring. However, it is sufficient to prevent the ring bouncing back from the completely closed position.

The successive firing of the thyristors $T_{S1}$ and $T_{S2}$ has the significant advantage that the stationary switch pieces 1 and 2 do not have to be dimensioned in accordance with the braking force on the contact ring 3 during the closing operation. The contact ring 3 merely has to have sufficient kinetic energy to reach the completely closed position counter to the friction of the stationary switch pieces 1 and 2. Bouncing back from there is not possible because of the second force impulse which then follows. In addition, the second triggering has the advantage that the capacitor $C_S$ swings over again in the process and is therefore positively charged again. A charging device which can produce only positive charge voltages can then be connected up directly again in order to recharge the capacitor $C_S$. Because of the residual charge voltage already present, this recharging operation is also considerably quicker than a new charging operation. For applications in which repeated triggering is needed, it is therefore possible for the charging device to be dimensioned smaller.

An opening operation essentially corresponds to the closing operation. The contact ring 3 is located in the gap 81, the capacitor $C_O$ is positively charged and the two thyristors $T_{O1}$ and $T_{O2}$ are off. By firing the thyristor $T_{O1}$ (or $T_{O2}$), which is polarized positively with respect to the charge voltage of the capacitor $C_O$, the capacitor $C_O$ is discharged via $T_{O1}$ ($T_{O2}$), the coil 5 and the freewheeling diode $D_{O1}$ ($D_{O2}$). Once again, the current effects an eddy current in the contact ring 3, which is then accelerated in the axial direction and released from the stationary switch pieces 1 and 2, forming two partial arcs connected in series. The contact ring 3 is moved in the axial direction in the annular space 8 and is only retarded again by the retaining device 10. In the embodiment illustrated, the retaining device 10 is constructed in the form of a narrowing of the annular space 8. When it reaches the annular space narrowing 10, the contact ring is completely braked and firmly held by friction. The slots L in the stationary switch pieces 1 and 2 prevent any formation of eddy current in the stationary switch pieces 1 and 2. The slots L run away from the gap 81 in the radial direction and have a length of about 1 cm.

Both for the closing operation and for the opening operation, the drive is based on the principle of electrodynamic repulsion. It is particularly advantageous that only the contact ring 3 is moved mechanically. It does not require any further moving parts for the transmission of force, triggering or the storage of energy. The electrodynamic drive also has the advantages of exact triggerability by firing a thyristor, the brief, quick-acting and very high impulse force and the uniform action of the force on the contact ring. By virtue of the axially symmetrical construction of the contact arrangement of the switching point according to the invention, the contact ring 3 is guided through the widened region 82 of the annular space 8 without any mechanical guide elements. The retaining device, with the annular space narrowing 10 extending conically at the upper end of the annular space 8, and the conically beveled, stationary switch pieces 1 and 2 at the lower end of the annular space 8 inherently effect centering of the contact ring 3.

The internal geometry of the annular space 8 can advantageously be utilized to retard the contact ring 3 during the opening operation or else to achieve in the annular space 8 a suitable flow of the gaseous medium present there. This is of decisive importance if the contact ring 3 loses contact at a time at which the nominal current $I_N$ is not zero. Even given the presence of a parallel path with a low DC resistance and low inductance, commutation arcs will be built up between the stationary switch pieces 1 and 2 and the contact ring 3, said arcs being cooled by the flow in the annular space 8 and by the insulation element 4. This results in a higher arc voltage, which in turn accelerates the commutation operation.

Figure 5:
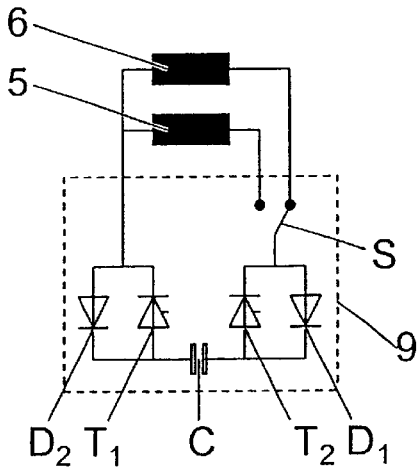
FIG. 5 shows a schematic illustration of a second embodiment of the switching point according to the invention with a second power electronic control unit.

In a second embodiment of the control unit of the switching point according to the invention, according to FIG. 5, only one capacitor C is provided, which can optionally be connected to one of the coils 5 or 6 to form a circuit by means of a switch S, via thyristors T1 and T2 with antiparallel-connected diodes D2 and D1.

The geometric dimensions of the contact arrangement of the switching point according to the invention depend on the nominal electrical data of the switching point. At a nominal current $I_N$ of the switching point of 5 kA and a nominal voltage of 12 kV, the diameter of the contact ring 3 is about 250 mm. Its thickness, corresponding to the width of the gap 81, is 8 mm. Given a height of a few millimeters, the contact ring 3, constructed from silver-plated aluminum, has a mass of a few tens to one hundred grams. The switching time for a switching point of this size is about 1 ms for each switching operation.

Although this invention has been illustrated and described in accordance with certain preferred embodiments, it is recognized that the scope of this invention is to be determined by the following claims.

What is claimed is:

1. A switching point in a high or medium voltage switch, said switching point comprising:

two stationary switch pieces;

a movable, electrically conductive bridge switch piece which short-circuits the stationary switch pieces when the switching point is closed;

a drive including two coils for generating an induction current in the bridge switch piece and a power electronic control unit for feeding the coils, in order to move the bridge switch piece;

the stationary switch pieces, the bridge switch piece and the coils being arranged symmetrically with respect to an axis;

the stationary switch pieces being constructed as cylinders led into one another and bounding an annular gap;

the bridge switch piece being constructed in the form of a contact ring which can be moved in the axial direction and which fits into the annular gap when the switching point is closed; and the two coils being arranged on either side of the contact ring and offset with respect to each other in the axial direction.

2. The switching point as claimed in claim 1, wherein a first of the two coils is held by an insulating element, wherein the insulating element bounds at least some sections of an annular space, said annular space extending in the axial direction between the coils; and wherein the contact ring is arranged in the annular space.

3. The switching point as claimed in claim 2, wherein the insulating element contains a device for retaining the contact ring when the switching point is open.

4. The switching point as claimed in claim 3, wherein the retaining device is constructed as a narrowing of the annular space in the area of the first coil.

5. The switching point as claimed in claim 2, wherein the annular space expanded in the axial direction has a region widened in the radial direction.

6. The switching point as claimed in claim 2, wherein the insulating element is designed to resist pressure, and in that a gaseous medium is enclosed in the annular space.

7. The switching point as claimed in claim 1, wherein the control unit contains a capacitor which is connected by a switch to one of the two coils through directional valves to form an electric circuit.

8. The switching point as claimed in claim 1, wherein the control unit contains first and second capacitors, of which the first capacitor is connected to the first coil through directional valves to form a first electric circuit, and the second capacitor is connected to the second coil through directional valves to form a second electric circuit.

9. The switching point as claimed in claim 7, wherein two oppositely directed valves are connected in series for each circuit.

10. The switching point as claimed in claim 9, wherein the valves are designed as thyristors with antiparallel-connected freewheeling diodes.

11. The switching point as claimed in claim 1, wherein the stationary switch pieces each have at least one slot running away from the gap in the radial direction.

* * * * *